US005676082A

United States Patent [19]

Kyle

[11] Patent Number: 5,676,082

[45] Date of Patent: Oct. 14, 1997

[54] HATCH ASSEMBLY FOR A MARINE VESSEL

[75] Inventor: James H. Kyle, Keene, N.H.

[73] Assignee: Pompanette, Inc., Charlestown, N.H.

[21] Appl. No.: 600,542

[22] Filed: Feb. 13, 1996

[51] Int. Cl.[6] ..... B63B 19/14

[52] U.S. Cl. ..... 114/201 R; 16/285; 49/386; 49/398; 49/476.1; 49/484.1; 114/178

[58] Field of Search ..... 114/201 R, 203, 114/177, 178, 176, 173; 16/217, 285, 378, 379; 49/386, 398, 476.1, 484.1

[56] References Cited

U.S. PATENT DOCUMENTS

| | | | |
|---|---|---|---|
| 957,603 | 5/1910 | Ellis | 16/285 |
| 3,181,204 | 5/1965 | Muessel | 49/476.1 |
| 4,363,350 | 12/1982 | Beckerer | 49/476.1 |
| 4,385,580 | 5/1983 | Davidson | 114/201 R |
| 5,231,948 | 8/1993 | Malmanger et al. | 114/201 R |
| 5,301,390 | 4/1994 | Cleal | 16/285 |

*Primary Examiner*—Sherman Basinger
*Attorney, Agent, or Firm*—David E. Dougherty

[57] ABSTRACT

A hatch assembly includes a first frame member having a generally J-shaped cross-section with a longitudinal extending or upright position and a generally parallel lip portion which is separated from the longitudinal portion by a horizontal section or riser. The assembly also includes a second frame member rotatably fixed to the first frame member. The second frame member includes a pair of elastomer seals fixed thereto so that a first of the seals engages the longitudinal portion of the J-shaped frame while the second seal engages the lip. The second frame member also includes a vent or small opening between the seals and a cavity for receiving any airborne water which passes through the vent. This vent is also constructed and arranged to drain air our of the cabin. In addition, the hatch assembly includes a hidden counterweight.

12 Claims, 2 Drawing Sheets

HATCH ASSEMBLY FOR A MARINE VESSEL

FIELD OF THE INVENTION

This invention relates to an improved marine hatch assembly having a hidden torsion spring for counterbalancing the hatch and more particularly to an improved marine hatch assembly having a sealing member with a generally J-shaped cross-section and two elastomeric elements for sealingly engaging the J-shaped sealing member.

BACKGROUND OF THE INVENTION

Cast aluminum hatch assemblies for marine vessels are well known. For example, such hatches are commercially available from Pompanette, Inc. of Charleston, N.H., the Assignee of the present invention. Such assemblies are described in the co-pending applications of A; Anderson entitled "Mechanism for Latching and Unlatching a Hatch Assembly," Ser. No. 08/317,545 U.S. Pat. No. 5,566,992 and my co-pending application entitled "Marine Hatch Assembly," Ser. No. 08/583,479, filed on Jan. 5, 1996, which are assigned to the same Assignee as the present invention. Both applications are included herein in their entireties by references. Such assemblies typically include a east aluminum alloy frame, an elastomeric gasket and a clear plastic cover. The hatch cover is typically made of a clear or tinted dear LEXAN sheet, a product of General Electric and has the strength of more than 5 inches of acrylic.

"Dorade" ventilators for ventilating boats which are underway are also well known. Such ventilators allow air and water to enter the vent while a series of baffles causes the water to fall out of the air flow and drain away prior to reaching the interior of a vessel. Other approaches for ventilators include hatches that have a vent position. For example, such hatches are opened about ⅛" so that gentle rain will not enter the vessel. This arrangement does not, however, protect the interior of the vessel against wind borne water or Spray.

It is presently believed that there may be a significant demand for an improved marine hatch assembly which includes a novel approach to ventilation. Accordingly, a hatch assembly in accordance with the present invention has been developed which works on Bernouli's principle in that the outside air flowing over the veto causes a lower pressure to form on the inside of the vent, thus exhausting air from the inside of the vessel. The hatch assemblies disclosed herein also include a double seal and are constructed and arranged to seal out wind borne water while allowing proper ventilation. This double seal is also constructed and arranged W seal the hatch against any entry of water even during hurricane condition or in extremely rough seas.

In addition, the novel hatch assemblies disclosed herein include a hidden counterweight. Such assemblies have a relatively low profile and present a pleasing appearance since the hinge and spring biased counterweight are hidden from view. The hatch assemblies can also be manufactured and sold at a competitive price, are relatively easy to install and service and are durable.

BRIEF SUMMARY OF THE INVENTION

A marine hatch assembly according to a first embodiment of the present invention includes a first frame member which defines an opening and a hatch cover for closing the opening. The assembly also includes a second frame member rotatably fixed to the first frame member and surrounding the hatch cover with a waterproof seal therebetween.

A marine hatch assembly for venting the interior of a vessel includes a first frame member which surrounds an opening in the vessel and a hatch cover for closing the opening. The assembly also includes a second frame member which surrounds the hatch cover and a waterproof seal between the second frame member and the hatch cover. The first frame member also defines a J-shaped cross-section or sealing member which includes a longitudinally extending portion, a rounded lip portion which is generally parallel with the longitudinal portion and a transverse portion or riser connecting the two generally parallel portions. First and second elastomeric sealing means are fixed to the second frame member about its periphery and positioned thereby in spaced relation to one another. As positioned, a first of the elastomeric sealing means sealing engages the longitudinally extending portion of the J-shaped sealing member when the hatch cover is in a fully closed position while the second of the elastomeric sealing means sealingly engages the rounded tip. The second frame member also includes vent means such as one or more small holes between the sealing means. The sealing means are also constructed and arranged so that the first elastomeric sealing means sealingly engages the longitudinally extending portion of the first frame member when the hatch cover is in a second or partially closed position. In this position, the second of the elastomeric sealing means is spaced from the rounded lip so that air can flow through the vent means and into or out of the vessel. For example, in the partially closed position with the vessel underway, outside air passing over the vent means will create a negative pressure on the inside of the hatch which will draw air from the inside of the cabin and vent the cabin.

In a second embodiment of the invention, a marine hatch assembly includes a first frame member which defines a generally rectangular opening with at least one fiat side or edge. The assembly includes a transparent or translucent hatch cover with a shape that corresponds to the shape of the opening and which is of about the same size for closing the opening. The second frame member surrounds the cover and is fixed to an outer periphery thereof. The second frame member which is preferably of an extruded aluminum alloy includes a fast cylindrical portion on an inner side thereof with a central bore running between its opposite ends. This first cylindrical portion also includes a pair of spaced apart cutouts intermediate of its ends and adjacent to one side of the second frame member and to one side of the opening. A pair of hinge plates are also provided and each includes a relatively fiat base portion and a complimentary cylindrical-like portion defining a central bore. The hinge plates are disposed on one side of the first frame member and adjacent to the cutouts in the first cylindrical portion. Means are also provided for fastening the base portion to the first frame member. The fiat base portion may, for example, be fastened to the first frame member with a pair of sheet metal screws with one side of each base portion including a second cylindrical portion which extends outwardly from the opening and with the complimentary cylindrical portion parallel to the one side of the opening. The complimentary cylindrical portions then fit relatively snugly within the cutouts within the first cylindrical portion with the bores in axial alignment. A hinge pin extends through the bore of each of the complimentary cylindrical portions and into the cylindrical portion of the second frame member so that the second frame member is rotatably lured to the first frame member. Means are also provided for fixing the hinge pin to the hinge plate to prevent longitudinal and rotational movement with respect thereto. A torsion spring is disposed within said cylindrical portion of the second frame member and fastened at one end thereof to the hinge pin and at an opposite end thereof to the second frame member so that the torsional energy of the spring act as a counterweight when the second frame member is in a selected position with respect to the first frame member.

In the preferred embodiment of the invention, the marine hatch assembly includes the combination of the elements set forth above with respect to the first and second embodiments of the invention.

The invention will now be described in connection with the accompanying drawings wherein like reference numerals are used to identify like parts.

DETAILED DESCRIPTION OF THE PREFERRED EMBODIMENT OF THE INVENTION

Figures 1, 2:
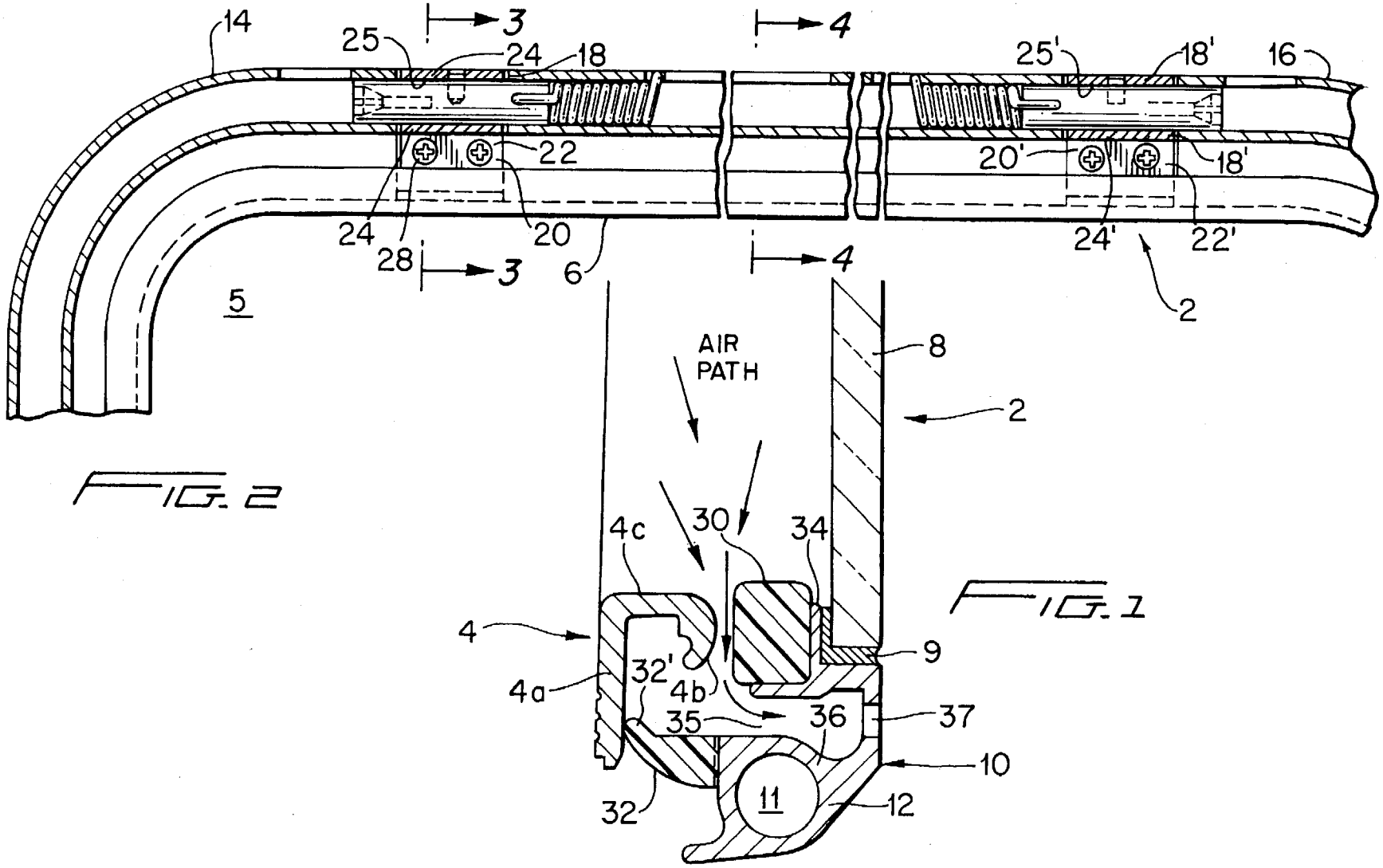
FIG. 1 is a partial cross-sectional view of a marine hatch assembly according to a first embodiment of the invention.
FIG. 2 is a top or plan view of a marine hatch assembly according to a second embodiment of the invention.
Figure 3:
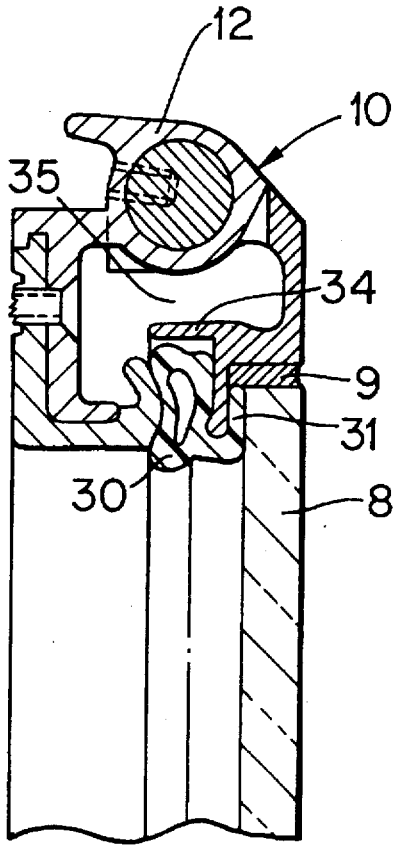
FIG. 3 is a cross-sectional view of the marine hatch assembly shown in FIG. 2 and taken along the 3—3 of FIG. 2.
Figure 4:
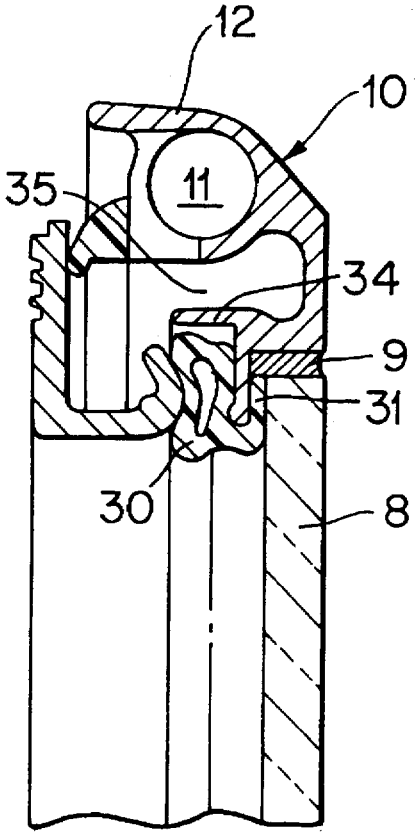
FIG. 4 is a cross-sectional view of the marine hatch assembly shown in FIGS. 2 and 3 taken along the line 4—4 FIG. 2.

A marine hatch assembly 2 according to the present invention will now be described with reference to the accompanying drawings. As shown more clearly in FIGS. 1 and 2, the hatch assembly 2 includes a first generally rectangular frame member 4 which defines a generally rectangular opening 5 a portion of which is shown in FIG. 2 in a vessel. The opening 5 is preferably in an upright or generally vertical plane as, for example, in the side of the vessel or cabin. It should be recognize, however, that the side of a vessel may be sloped and the generally vertical plane may be displaced further as a vessel heels under sail or rocks in rough water. This opening 5 has at least one fiat side or edge 6 which in a typical installation would be along a fore/aft line of a vessel. The assembly also includes a generally rectangular or translucent hatch cover 8 with a shape that corresponds to the shape of the opening 5. The cover 8 is disposed outwardly, i.e., toward the outside of a vessel from the first frame member 4, and is of about the same size as the opening 5 or slightly larger and is adapted for closing the opening, i.e., for closing the hatch against the elements.

In a preferred embodiment of the invention, a second frame member 10 surrounds the cover 8 and is fixed to an outer periphery of the cover 8 with a waterproof seal 9 therebetween. The second frame member 10 which is preferably of an extruded aluminum alloy encompasses the cover 8 and includes a first portion 12 which may be referred to as a generally cylindrical-like portion with a central cylindrical bore 11 running between opposite ends 14 and 16. These opposite ends 14 and 16 refer to the ends of the first portion with respect to its exterior along the flat side or edge 6. The first portion 12 or generally cylindrical-like portion embodies the bore 11 which preferably has a cylindrical cross-section. This portion 12 also includes at least one and preferably a pair of cutout portions 18, 18' in between the ends 14 and 16, and adjacent to one side of the second frame member 10 and to one side of the opening 5. A pair of hinge plates 20, 20' includes relatively flat base portions 22, 22' and complimentary cylindrical potions 24, 24'. These complimentary cylindrical portions 24, 24' include central bores 25, 25' and are preferably disposed on one side of the flat base portion 22, 22'.

Fastening means 28 such as a pair of sheet metal screws are provided for fastening each of the base portion 22, 22' to one side of the fast frame member as illustrated in FIG. 2. Fastening means 28 are disposed on a first side of the base portion 22, 22' and arranged so that the opposite sides of the base portion 22, 22', including the so-called complimentary cylindrical portions 24, 24' extends outwardly away from and above the opening 5. The complimentary cylindrical portions 24, 24' then fit relatively snugly within the cutouts 18, 18' in the first cylindrical portion 12 with the bores coaxially aligned.

In the hatch assembly 2 in accordance with the preferred embodiment of the invention, the frame member defines a generally J-shaped cross-section or sealing member with a longitudinally extending portion 4*a* and rounded lip 4*b* opposite the longitudinally extending portion 4*a* and separated therefrom by a transverse portion riser 4*c*. In addition, the assembly includes first and second elastomeric sealing means 30 and 32 fixed to the second frame member 10 and positioned thereby in spaced relation to one another. The elastomeric sealing means 30 and 32 are also constructed and arranged so that a first of the elastomeric sealing means 32 sealingly engages the longitudinally extending portion 4*a* of the first frame member 4 when the hatch is in a first or fully closed position. In this position, i.e., the fully closed position, a second of the elastomeric sealing means 30 sealingly engages the rounded lip 4*b*. The second frame member 10 also includes vent means 37 such as one or more relatively small opening between the first and second elastomeric sealing means. The elastomeric sealing means 30 and 32 are also constructed and arranged so that the first of the elastomeric sealing means 32 sealingly engages the longitudinally portion 4*a* of the first frame member 4 when the hatch is in a second or partially closed position. When the hatch is in this second partially closed or vent position, the second elastomeric sealing means 30 is spaced from the lip so that the air can pass between the lip and the second elastomeric sealing means and through the vent means 37 and into or out of the vessel. The vent means 37 are preferably disposed only in the lower potion of the assembly. As shown, the second frame member 10 includes a relatively complex shape which includes an L-shaped portion 34 and the so-called cylindrical portion 12. The L-shaped cross-sectional portion 34 is separated from the so-called cylindrical portion 12 by a channel 35 which also defines a concave area 36.

As previously stated, the second frame member 10 includes the vent means 37, such as a relatively small hole or a plurality of small holes. The vent means 37 is preferably adjacent to the concave portion 36. This concave portion 36 is also disposed below the vent means 37 so that any airborne water which passes through the vent means or opening 37 drops into the concave portion or cavity 36. It should also be recognized that because the opening or openings 37 are relatively small, i.e., about ⅛" to ¼" in diameter with respect to the cross-sectional area of passage 35, any airflow through the passage 35 will move at a relatively slow rate. Accordingly, any airborne water will drop into the concave portion 36 and will not enter the interior of the vessel. In addition, the area, or more precisely, the volume defined by the cavity is relatively large with respect to the size of the vent means 37 so that the cavity is sufficient to contain any airborne water that drops therein. Subsequently, opening the hatch outwardly allows the accumulate water to drain out on the outside of the vessel. The water may drain out through one or more narrow notches (not shown) in the second sealing means or gasket 32 or at the ends thereof. The notches, for example, may comprise narrow slits having a width of about ⅛". In a typical installation, the water will drain out of at the ends of the second sealing means 32 since the second sealing means only extends part way around the frame 10. In the preferred embodiment of the invention, there is no need for the sealing means or gasket 32 at the top or upper part of the assembly because the sealing means 30 seals the upper portion of the assembly even when the hatch is in the partially closed position.

In the preferred embodiment of the invention, the first elastomeric seal or gasket 30 has a generally square cross-section. And, in the preferred embodiment, this gasket 30 includes a hollow rectangular portion with an appendage 31 forming a channel adapted to receive one leg of the L-shaped portion 34 therein. In this form, the appendage 31 forms a seal between the second frame member 10 and the hatch cover 8 and positions and holds the gasket 30 on the frame member 10.

The second seal or gasket 32 is also made of a suitable elastomeric material as will be well understood by those skilled in the art. The second gasket preferably defines a comma shaped cross-section with an appendage 32' which forms a seal with the longitudinal extending portion **4*a* of the J-shaped frame member 4. As shown more clearly in FIG. 1, the appendage 32' of the comma shaped gasket forms a seal to keep airborne water from entering the vessel through the hatch assembly 2**.

Figure 5:
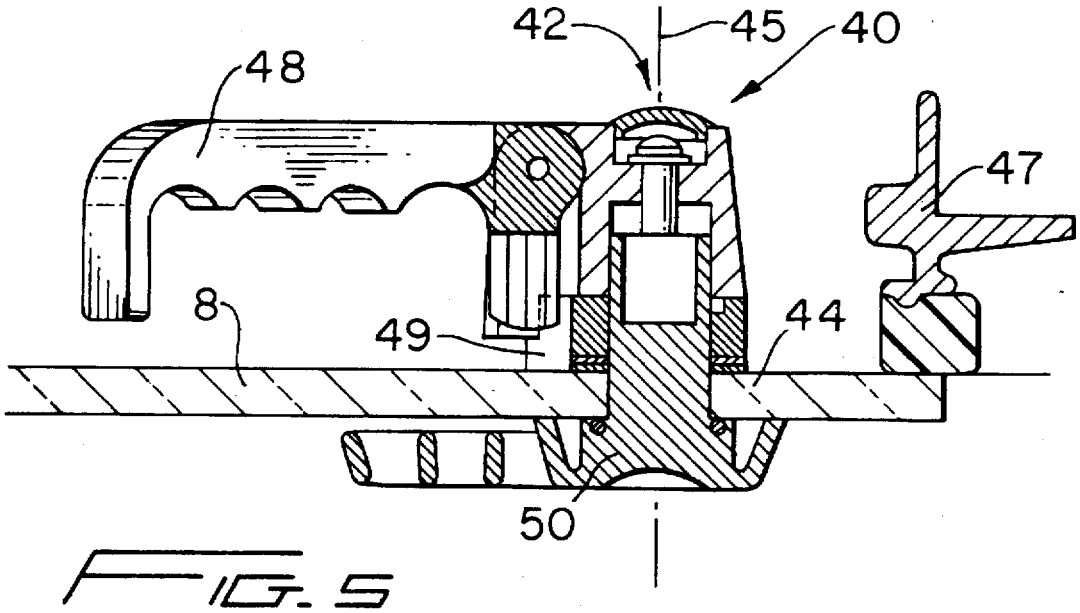
FIG. 5 is a cross-sectional view of a latching mechanism for use with the assemblies of FIGS. 1–4.

The mechanism for latching and unlatching a hatch assembly may be of any suitable design as will be well understood by those skilled in the art. For example, the mechanism described in the aforementioned Anderson application, Ser. No. 08/317,545, now Pat. No. 5,566,992, may be used. As shown in FIG. 5, a hatch dog handle mechanism 40 includes a hub assembly 42 which is mounted on a first portion 44 of the hatch cover 8. The hub assembly 42 rotates about a central axis 45 to position a rotatable member (not shown) to engage an element 47 or a portion of the first frame member 4. As illustrated in FIG. 5, the latching mechanism also includes a handle 48 and appropriate mechanism 49 for positioning the handle in a fixed or rotatable position as described in the aforementioned application. The latching mechanism shown may also include an integral handle 50 which allows the hatch to be latched or unlatched from the outside of the vessel when the handle 48 is in an unlatched position. The hatch assembly also includes means such as a stepped latch (not shown) for latching the hatch in a fully closed or partially closed position.

While the invention has been described in connection with its preferred embodiments, it should be recognized that changes and modifications may be made therein without departing from the scope of the claims.

What is claimed is:

1. A marine hatch assembly for venting the interior of a vessel comprising a first frame member defining an opening in the vessel, a hatch cover for closing said opening and a second frame member surrounding said hatch cover, and a waterproof seal between said cover and said second frame member, said first frame member defining a J-shaped cross-section with a longitudinally extending portion and a rounded lip opposite said longitudinally extending portion, first and second elastomeric sealing means fixed to said second frame member and positioned thereby in spaced relation to one another so that a first of said elastomeric sealing means sealingly engages said longitudinally extending portion of said first frame member when said hatch cover is in a first or fully closed position and the second of said elastomeric sealing means sealingly engages said rounded lip when said hatch cover is in the first position, said second frame member also including vent means between said first and second elastomeric sealing means, said first and second sealing means constructed and arranged so that the first of said elastomeric sealing means sealingly engages said longitudinally extending portion of said first frame member when said hatch cover is in a second or partially closed position with said second of said elastomeric sealing means spaced from said lip so that air can flow through said vent means when said hatch cover is in the second or partially closed position.

2. A marine hatch assembly for venting the interior of a vessel according to claim 1 in which said opening defines a generally rectangular shape and in which said vent means comprises a relatively small opening in said second frame member.

3. A marine hatch assembly for venting the interior of a vessel according to claim 2 in which said second frame member also defines a cavity adjacent to said vent means for accumulating any water that passes through said vent means.

4. A marine hatch assembly for venting the interior of a vessel according to claim 3 in which said hatch assembly is positioned along a generally vertical axis, and in which said assembly includes a pair of hinge plates and hinge pins positioned at the top of the hatch assembly.

5. A marine hatch assembly for venting the interior of a vessel according to claim 4 in which said second frame member includes an L-shaped portion for supporting and positioning said second elastomeric sealing means and in which said second elastomeric sealing means is fixed to said L-shaped portion.

6. A marine hatch assembly for venting the interior of a vessel according to claim 4 in which said second elastomeric sealing means has a generally rectangular hollow structure.

7. A marine hatch assembly for venting the interior of a vessel comprising a first frame member defining an opening in the vessel, said opening having at least one generally flat side, a hatch cover for closing said opening and a second frame member rotatably fixed to said first frame member and surrounding said hatch cover, and a waterproof seal between said cover and said second frame member, said second frame member including a first portion having a central bore and opposite ends and a pair of cut outs in said first portion intermediate of said ends and adjacent to one side of said second frame member and to said flat side of said opening, a pair of hinge plates including a base portion and a complimentary portion defining a central bore disposed on one side of said base portion and means for fastening said base portions of said hinge plates to said first frame member with one side of said base portions including said complimentary portion extending outwardly from said opening and with said complimentary portions parallel to said one side of said opening and said complimentary portions fitting within said cut outs in said first portion and with the central bore of said first portion and said central bore of said complimentary portion coaxially aligned, a hinge pin extending through the bore of each of said complimentary portions and into said first portion of said second frame member so that said second frame member rotates on said hinge pins, means for fixing said hinge pin to said hinge plate for preventing rotation of said hinge pin within said complimentary portion of said hinge plate and a torsion spring disposed within said central bore of said second frame member and connected at one end thereof to said hinge pin and at an opposite end thereof to said second frame member so that said spring biases said hatch into a preselected position.

8. A marine hatch assembly for venting the interior of a vessel according to claim 7 in which said opening defined by said first frame member has a generally rectangular shape.

9. A marine hatch assembly for venting the interior of a vessel according to claim 8 in which said torsion spring is a coil spring having a diameter which is slightly smaller than the diameter of said central bore of said second frame member.

10. A marine hatch assembly for venting the interior of a vessel comprising a first frame member defining an opening in the vessel, said opening having at least one generally flat side, a transparent or translucent hatch cover for closing said opening and a second frame member surrounding said hatch cover, and a waterproof seal between said cover and said second frame member, said first frame member defining a J-shaped cross-section with a longitudinally extending portion and a rounded lip opposite said longitudinally extending portion, first and second elastomeric sealing means fixed to said second frame member and positioned thereby in spaced relation to one another so that a first of said elastomeric sealing means sealingly engages said longitudinally extending portion of said first frame member when said hatch cover is in a first or fully closed position and the second of said elastomeric sealing means sealingly engages said rounded lip when said hatch cover is in the first position, said second frame member also including vent means between said first and said second elastomeric sealing means, said first and second sealing means constructed and arranged so that the first of said elastomeric sealing means sealingly engages said longitudinally extending portion of said first frame member when said hatch cover is in a second or partially closed position with said second of said elastomeric sealing means spaced from said lip so that air can flow through said vent means when said hatch cover is in the second or partially closed position, said second frame member also including a first generally cylindrical-like portion having a central bore and opposite ends and a pair of cut outs in said cylindrical-like portion intermediate of said ends and adjacent to one side of said second frame member and to said flat side of said opening, a pair of hinge plates including a base portion and a complimentary cylindrical portion defining a central bore disposed on one side of said base portion and means for fastening said base portions of said hinge plates to said first frame member with one side of said base portions including said complimentary cylindrical portions extending outwardly from said opening and with said complimentary cylindrical portions parallel to said one side of said opening and said complimentary cylindrical portions fitting within said cut outs in said first cylindrical portion and with the bores of said first cylindrical portion and said complimentary cylindrical portion coaxially aligned, a hinge pin extending through the bore of each of said complimentary cylindrical portions and into said cylindrical portion of said second frame member so that said second frame member rotates on said hinge pin, means for fixing said hinge pin to said hinge plate for preventing rotation of said hinge pin within said complimentary cylindrical portion of said hinge plate and a torsion spring disposed within said cylindrical portion of said second frame member and connected at one end thereof to said hinge pin and at an opposite end thereof to said second frame member so that said spring counterbalances said hatch.

11. A marine hatch assembly for venting the interior of a vessel according to claim 10 in which said second frame member also defines a cavity adjacent to said vent means for accumulating any water that passes through said vent means.

12. A marine hatch assembly for venting the interior of a vessel according to claim 11 in which said hatch assembly is positioned along a generally vertical axis with said hinge plates and said hinge pins positioned at the top of the hatch assembly.

* * * * *